US005794473A

United States Patent [19]

Palzer

[11] Patent Number: 5,794,473

[45] Date of Patent: Aug. 18, 1998

[54] METHOD OF REGULATING THE CROSS-SECTION OF ROLLING STOCK

[75] Inventor: Otmar Palzer, Aldenhoven, Germany

[73] Assignee: SMS Schloemann-Siemag Aktiengesellschaft, Düsseldorf, Germany

[21] Appl. No.: 755,331

[22] Filed: Nov. 22, 1996

[30] Foreign Application Priority Data

Nov. 23, 1995 [DE] Germany ..... 195 43 605.9

[51] Int. Cl.[6] ..... B21B 37/68

[52] U.S. Cl. ..... 72/8.9; 72/8.3; 72/11.1; 72/11.6; 72/12.7

[58] Field of Search ..... 72/8.3, 8.9, 9.3, 72/11.1, 11.2, 11.6, 11.8, 11.9, 8.6, 11.4, 12.3, 12.7, 12.8, 205, 225, 227, 250

[56] References Cited

U.S. PATENT DOCUMENTS 5,709,119 1/1998 Palzer ..... 72/227

FOREIGN PATENT DOCUMENTS 4407981 9/1995 Germany .

55-45585 3/1980 Japan ..... 72/205
57-88908 6/1982 Japan ..... 72/205
118517 1/1989 Japan ..... 72/205
1278905 11/1989 Japan ..... 72/205
3146210 6/1991 Japan ..... 72/8.6
422505 1/1992 Japan ..... 72/12.8
5146811 6/1993 Japan ..... 72/11.4
5177226 7/1993 Japan ..... 72/8.9
6285521 10/1994 Japan ..... 72/8.9
1094634 5/1984 U.S.S.R. ..... 72/205
1097403 6/1984 U.S.S.R. ..... 72/205
1186308 10/1985 U.S.S.R. ..... 72/205

*Primary Examiner*—Lowell A. Larson
*Assistant Examiner*—Ed Tolan
*Attorney, Agent, or Firm*—Friedrich Kueffner

[57] ABSTRACT

A method of regulating the cross-section of rolling stock through a looper for the rolling stock, particularly between roll stands in section rolling mills. In accordance with the method, the horizontal forces in the rolling stock are varied by varying the loop height, and width increases or width adjustments of the rolling stock are purposefully influenced through the horizontal forces.

3 Claims, 3 Drawing Sheets

METHOD OF REGULATING THE CROSS-SECTION OF ROLLING STOCK

BACKGROUND OF THE INVENTION

1. Field of the Invention

The present invention relates to a method of regulating the cross-section of rolling stock through a looper for the rolling stock, particularly between roll stands in section rolling mills.

2. Description of the Related Art

In order to be able to roll with certainty almost without tension between two successive stands, vertical or horizontal loops are formed between the roll stands as the rolling stock travels through the group of finishing stands of known rolling trains. Horizontal loopers used for building up and for decreasing the loops include an ejector roller which is swung out by means of at least one pneumatic cylinder or hydraulic cylinder. If a vertical looper is also present, the ejector roller for the vertical loop can be driven and swung out for forming the loop by means of a lever linkage with a pneumatic cylinder or hydraulic cylinder connected in an articulated manner to the lever linkage. This process is supported by a regulation which serves to build up the loop and to keep the loop constant at a predetermined value during rolling.

The looper limits the two horizontal or vertical end positions of the loop and holds the loop as much as possible in the middle of the looper table. Taken into consideration in this connection are the influences occurring during the rolling process, such as changes in the cross-section, for example, due to changing occupation of the preceding multiple-line stands, the temperature of the rolling stock, etc., wherein these influences are reflected in changes of the speed and length and, thus, in changes of the loop size. The regulation operates with the aid of a photoelectric scanning means of the rolling stock and acts independently of the direction of a cascade regulation on the rate of rotation of the preceding stand or the following stand.

To make it possible in this known looper to make the looper less complicated and to reduce the operating costs and to improve the build-up and the reduction of the loop, it has been disclosed in DE 44 07 981 A1 to permit the rolling stock emerging from the roll stand to drop as a result of gravity, to deflect the front end of the rolling stock in the direction toward the subsequent roll stand and then to temporarily support the rolling stock during the deflection phase until the front end of the rolling stock has entered the subsequent stand and the looper stabilizes the loop. The formation of the loop as a result of gravity carried out in this manner significantly reduces the requirements which have to be made of the dynamics of the looping control.

The significantly increased demands with respect to output and quality in section rolling mills require in addition to the looping control also a regulation of the cross-section, so that the accuracy to size of the final product can be achieved in spite of the significantly varying input parameters and rolling parameters of the billets. Because of the varying input parameters (temperature, cross-section, material properties, tensile forces and compressive forces) of the billets, the final dimensions of the final products also vary accordingly. Especially the temperature variations and the tensile forces and compressive forces in the rolling stock during rolling decisively influence the achievable tolerances of the finished product. Additional factors which directly or indirectly influence the final dimensions of the of product must be taken into consideration, for example, the roll wear, the thermal condition of the roll and the bending of the roll which depends on the roll groove.

Known cross-section regulating systems are with respect to their basic concept a further development of an automatic gauge control or AGC which is well known in the manufacture of flat products. For reasons of costs, a hydraulic adjustment of the control was usually replaced by an electromechanical adjustment. Of the complex automatic gauge control used in the case of flat products with relative and absolute AGC, it is frequently only the monitor control which is used in section rolling mills, wherein the number of roll stands varies with a control which is similar to AGC. If all roll stands are equipped with such a control, the cross-section control is based on a process model which includes the deformation control. For realizing the known cross-section control, a continuous tension/compression control operating with low tolerances is a requirement. In the case of larger crosssections of the rolling stock, this can be realized in practice only by a quotient tension/compression control. This makes it necessary to equip the entire rolling train with rolling force measuring cells which cost money and which additionally increase the required maintenance because of their susceptibility to heat and moisture.

SUMMARY OF THE INVENTION

Therefore, it is the primary object of the present invention to provide a method of the above-described type in which the described disadvantages can be avoided and which facilitates an improved cross-section control without complex technical requirements with respect to measurement and control and without mechanical devices.

In accordance with the present invention, the horizontal forces in the rolling stock are varied by varying the loop height, and width increases or width adjustments of the rolling stock are purposefully influenced through the horizontal forces.

The invention starts from the finding that a functional relationship exists between the loop height and the horizontal forces, i.e., tension and compression, of a rolling stock loop, as indicated in FIG. 1 of the drawing. A certain horizontal force in the rolling stock corresponds to each loop height, wherein this horizontal force has a decisive influence during rolling on the rolling stock dimensions to be achieved.

The relationship between the horizontal forces and the rolling stock dimensions is illustrated in FIG. 2 for round sections and angle sections. Thus, FIG. 2 shows that especially the width of the rolling stock depends significantly on the horizontal forces and that the height and thickness of the section change only slightly under the influence of the horizontal forces. As is well known, the section height changes only slightly during rolling because of the relatively high stiffness of the stand, while the width varies significantly over the length of the rolling stock.

The findings and relationships discussed above are utilized in accordance with the present invention in such a way that by a changing the loop height, the horizontal forces and, thus, the width increase of the rolling stock is influenced directly by the loop height in such a way that the dimensions of the final product are guaranteed to be within the permissible tolerance range. Although the above-described gravitational loop is suitable for the cross-section control according to the present invention in an advantageous manner, the invention can also be used in conventionally constructed vertical loopers and horizontal loopers. Accordingly, it is possible to compensate the width variations of the rolling stock which are primarily due to the variations of the rolling parameters.

The operation of the cross-section control according to the present invention is surprisingly simple. When the measured rolling stock width moves out of the permissible tolerance range, the horizontal force in the rolling stock is influenced through the loop height in such a way that the rolling stock width again returns into the permissible tolerance range. For example, when the emerging rolling stock width is too great, the loop height is corrected through the looping control toward zero and vice versa. Although the section height or rolling stock thickness remains almost constant due to the relatively high stiffness of the roll stand, the rolling stock height is nevertheless also permanently monitored and evaluated. When the rolling stock height departs during the correction of the width from the permissible tolerance range during the start-up of the train, the width control is temporarily interrupted until the rolling stock thickness has been returned once again by the technological influences into the permissible tolerance range. After the rolling stock has emerged, the roll gap is corrected accordingly in order to provide more space for the width control of the next billet.

For carrying out the width control according to the present invention, only a commercially available measuring device for measuring the width or thickness of the rolling stock is required in addition to the standard devices for realizing a loop control, preferably in the form of a gravitational loop, for which essentially only a foldable chute with scanner is required. For monitoring and parameterization, a terminal with monitor and keyboard can be provided for an operator.

A preferred embodiment of the present invention provides that the width control of the rolling stock is superimposed by an underload correction of the roll adjustments of the roll stands which participate in the section control through the looping control. This makes it possible to achieve a two-dimensional control and to prevent the section height from being corrected only in the interval between two billets by the roll adjustment for the next billet in order to be able to carry out the necessary width correction.

Consequently, width deviations of the rolling stock or billet which is in the process of being rolled can be fully regulated, so that already this billet is in the permissible tolerance range and not only the next following billet. Consequently, the section height control superimposed on the width control results in a two-dimensional cross-section control.

Accordingly, the cross-section control according to- the present invention can be realized in two variations: a) one-dimensional control (width) b) two-dimensional control (width and height)

In the case of the one-dimensional control, practically only the section width is continuously controlled during rolling through the loop height, wherein the section height is corrected in the intervals between two successive billets, i.e., without load.

In the case of two-dimensional control, in addition to the width as described above, also the section height is continuously controlled, i.e., a correction is carried out under load.

As is the case in the one-dimensional cross-section control, several loops can be provided for the cross-section control in the case of two-dimensional control when greater variations of the Ace rolling stock dimensions occur, wherein the two-dimensional cross-sectional control requires for each additional loop an additional roll stand which is adjustable under load. On the other hand, contrary to conventional controls, the one-dimensional cross-section control, i.e., control of only the width, requires no adjustments under load.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DESCRIPTION OF THE PREFERRED EMBODIMENTS

Figure 1:
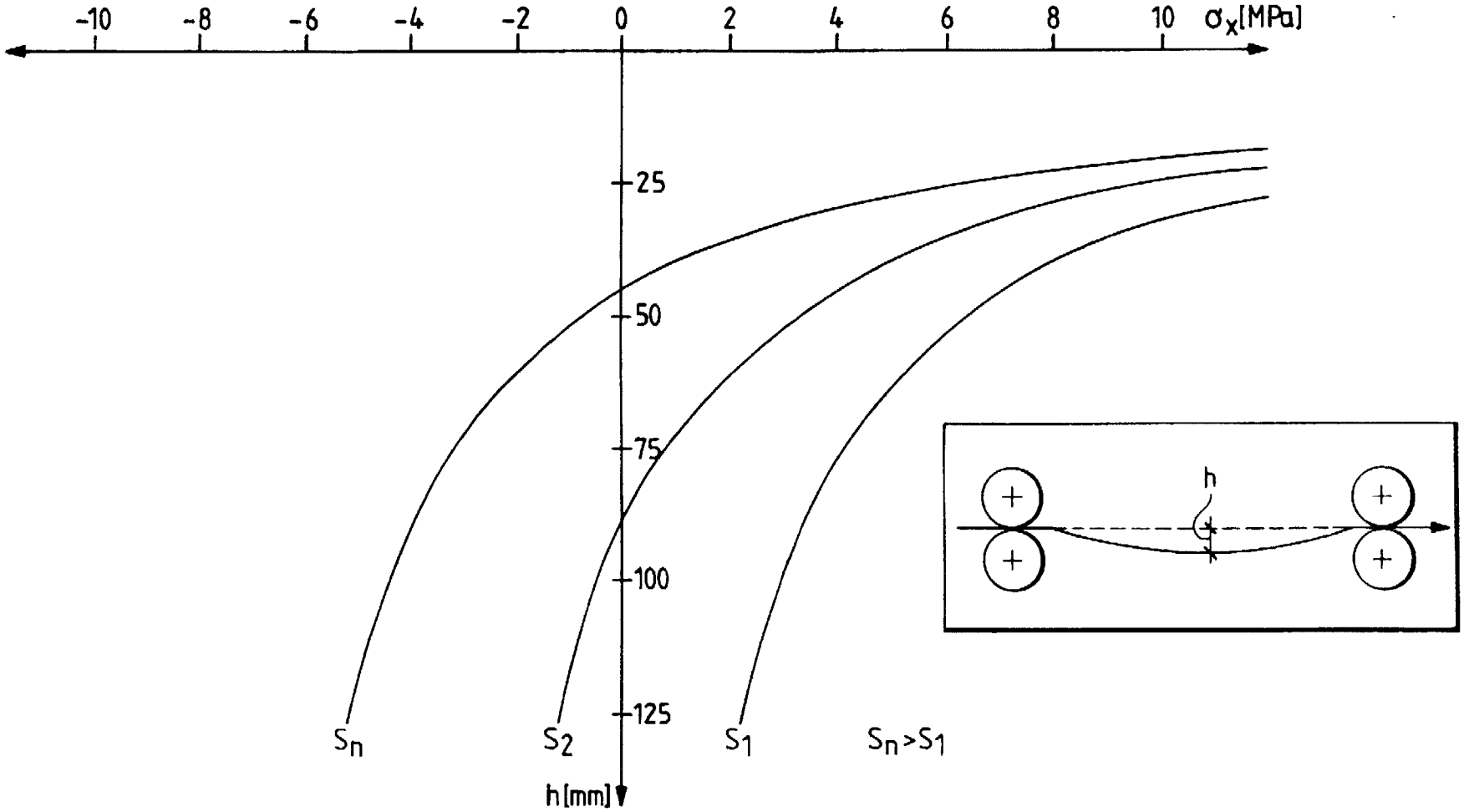
FIG. 1 is a diagram illustrating the relationship between the loop height and the horizontal forces (tension/compression) in a rolling stock loop.
Figure 2:
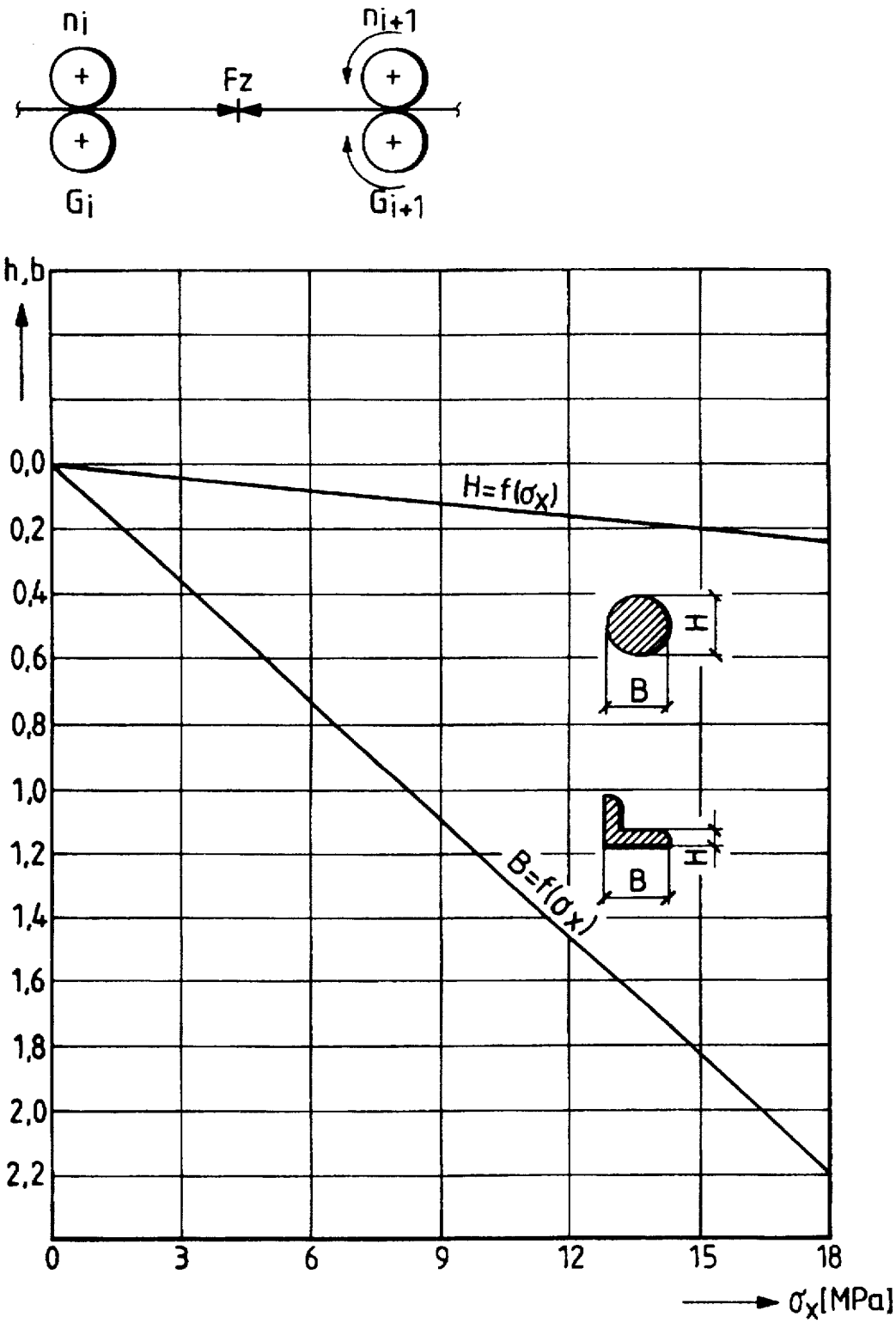
FIG. 2 is a diagram illustrating the relationship between the horizontal forces and the rolling stock dimensions with round sections and angle sections as examples.

The diagrams of FIGS. 1 and 2 have been discussed above, so that a further description thereof is not required. However, it is pointed out that in FIGS. 1 and 2 h=loop height $\sigma_x$=tension/compression

S=rolling stock cross-section

B=rolling stock width

H=rolling stock thickness.

Figure 3:
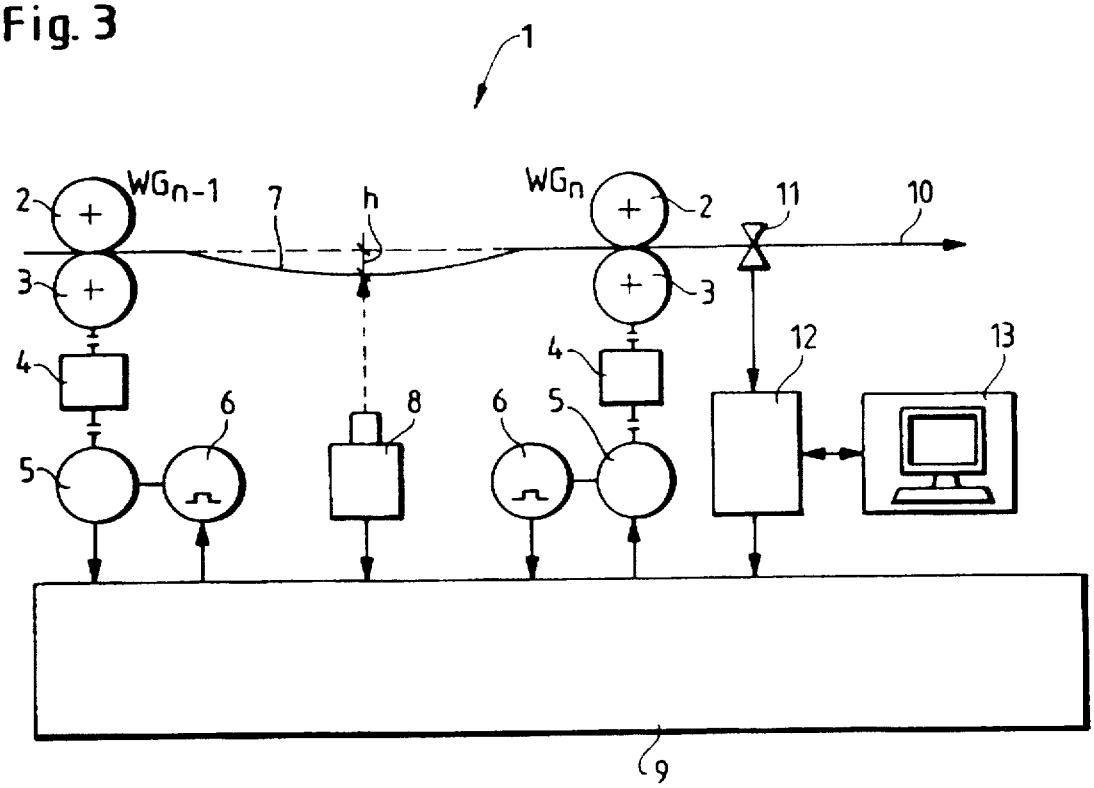
FIG. 3 is a schematic illustration of a plant for controlling the width of rolling stock through the loop height.
Figure 4:
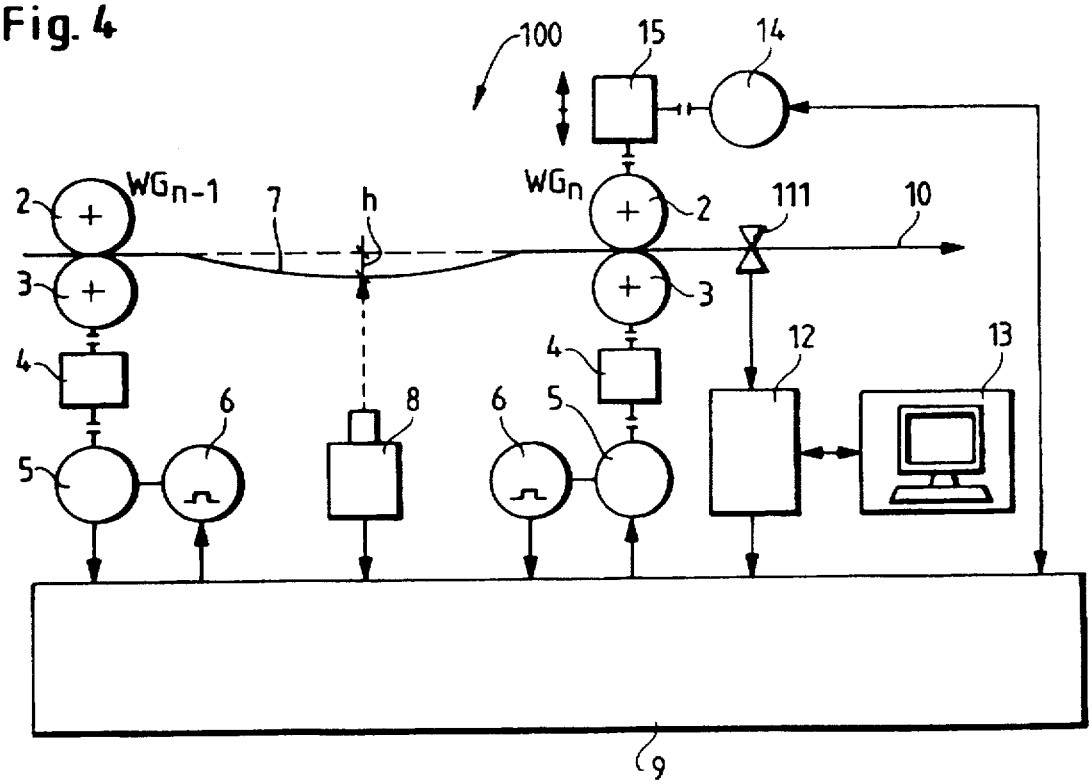
FIG. 4 is a schematic illustration of a plant for continuously controlling width and thickness of rolling stock through the loop height.

As part of a finishing or intermediate train 1, 100 of a small section and wire train, not shown, FIGS. 3 and 4 show roll stands $WG_{n-1}$ and $WG_n$ which are merely symbolically illustrated by an upper horizontal roll 2 and a lower horizontal roll 3, respectively. Motors 5 connected to a pulse generator 6 are provided for the roll stands $WG_{n-1}$ and $WG_n$ through an intermediately arranged gear unit 4 each.

The height h of a rolling stock loop 7 built up between the two roll stands $WG_{n-1}$ and $WG_n$ is determined by a scanner 8 and is delivered to a control unit 9 shown as a black box. A measuring device 11, or 111 as shown in FIG. 4, which determines the width B and the height H of the rolling stock, is arranged following the last roll stand $WG_n$ in rolling direction 10 as indicated by an arrow and the measuring device 11, 111 is connected through a control unit 12 to the control unit 9 as well as to a terminal 13 which is equipped with an appropriate keyboard for monitoring and parameterization by an operator. Also connected to the control unit 9 are the motor 5 of the roll stand $WG_{n-1}$ and the pulse generator 6 of the motor 5 of the roll stand $WG_{n-1}$.

Referring to the embodiment of FIG. 3, when the rolling stock width determined by the cross-section measuring device 11 deviates from the permissible tolerance range, the automatic control unit 9 changes the height H of the rolling stock loop 7 as monitored by the scanner 8 and, thus, the horizontal force in the rolling stock is influenced in such a way that the rolling stock width again returns into the permissible tolerance range. In addition, the cross-section measuring device 11 simultaneously continuously monitors and evaluates the rolling stock thickness or rolling stock height H. When the rolling stock height H deviates during the width correction from the permissible tolerance range, the width control is interrupted in the case of a one-dimensional control until the rolling stock height H again returns into the permissible range.

The finishing and intermediate train 100 according to FIG. 4 differs from the finishing and intermediate train shown in FIG. 3 in that the last roll stand WGn in rolling direction 10 is provided with an underload adjustment 15 (adjustment spindle) driven by a motor 14 which is connected to the automatic control unit 9. This arrangement makes possible a continuous width control and thickness or height control of the rolling stock, which means that a simultaneous height correction provides additional space for the width control. Consequently, the principal dimensions (width and height) of the rolling stock can be continuously influenced by utilizing the above-described control of the loop height h of the rolling stock loop 7 and the resulting change of the horizontal force in the rolling stock which determines the influence on the width. The underload correction of the roll adjustment superimposed on the width control and the two-dimensional control achieved as a result make it possible to keep even the rolling stock being rolled at the moment within the permissible tolerance range when width deviations occur, so that the correction does not start only in the next following rolling stock.

While specific embodiments of the invention have been shown and described in detail to illustrate the inventive principles, it will be understood that the invention may be embodied otherwise without departing from such principles.

I claim:

1. Method of regulating a cross-section of rolling stock through a rolling stock loop control between roll stands of a section rolling train, the method comprising changing horizontal forces in the rolling stock by changing a loop height of a rolling stock loop and purposely influencing width changes of the rolling stock through the horizontal forces.

2. The method according to claim 1, wherein the rolling stock are billets, comprising correcting a section height by a roll gap correction between two successive billets.

3. The method according to claim 1, comprising superimposing the width control of the rolling stock by an underload correction of roll adjustments of roll stands participating in the loop regulation.

* * * * *

US005794473B1

REEXAMINATION CERTIFICATE (4144th)

United States Patent [19] [11] B1 5,794,473

Palzer [45] Certificate Issued Aug. 29, 2000

[54] METHOD OF REGULATING THE CROSS-SECTION OF ROLLING STOCK

[75] Inventor: Otmar Palzer, Aldenhoven, Germany

[73] Assignee: SMS Schloemann-Siemag Aktiengesellschaft, Dusseldorf, Germany

Reexamination Request:
No. 90/005,302, Apr. 12, 1999

Reexamination Certificate for:

| | |
|---|---|
| Patent No.: | **5,794,473** |
| Issued: | **Aug. 18, 1998** |
| Appl. No.: | **08/755,331** |
| Filed: | **Nov. 22, 1996** |

[30] Foreign Application Priority Data

Nov. 23, 1995 [DE] Germany ..... 195 43 605

[51] Int. Cl.[7] ..... B21B 37/68

[52] U.S. Cl. ..... 72/8.9; 72/8.3; 72/11.1; 72/11.6; 72/11.7

[58] Field of Search ..... 72/8.3, 8.9, 9.3, 72/11.1, 11.2, 11.6, 11.8, 11.9, 12.7, 12.8, 205, 225, 227, 250, 8.6, 11.4, 12.3

[56] References Cited

U.S. PATENT DOCUMENTS 3,763,678 10/1973 Dornbusch et al. .
5,305,624 4/1994 Backhaus ..... 72/12

FOREIGN PATENT DOCUMENTS 0 375 094 A2 6/1990 European Pat. Off. .
0 375 094 A3 6/1990 European Pat. Off. .
9000451 1/1990 WIPO .

OTHER PUBLICATIONS

Patent Abstracts of Japan, vol. 012, No. 179 (M–701), May 26, 1988 & JP 62 289307 A (Kawasaki Steel Corp), Dec. 16, 1987.

Patent Abstracts of Japan, vol. 014, No. 552 (M–1056), Dec. 7, 1990 & JP 02 235511 A (Sumitomo Metal Ind Ltd), Sep. 18, 1990.

*Primary Examiner*—Ed Tolan

[57] ABSTRACT

A method of regulating the cross-section of rolling stock through a looper for the rolling stock, particularly between roll stands in section rolling mills. In accordance with the method, the horizontal forces in the rolling stock are varied by varying the loop height, and width increases or width adjustments of the rolling stock are purposefully influenced through the horizontal forces.

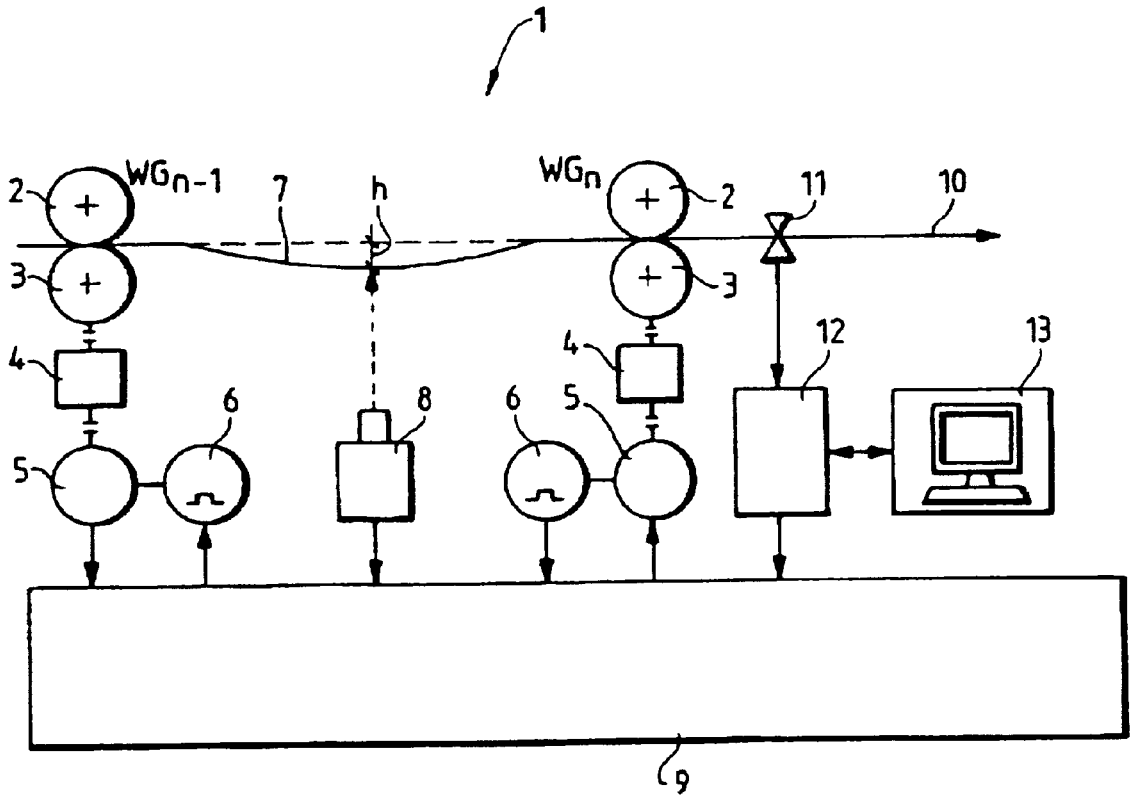

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–3 are cancelled.

* * * * *